US005666632A

United States Patent [19]

Maulik

[11] Patent Number: 5,666,632

[45] Date of Patent: Sep. 9, 1997

[54] VALVE SEAT INSERT OF TWO LAYERS OF SAME COMPACT DENSITY

[75] Inventor: Paritosh Maulik, Coventry, United Kingdom

[73] Assignee: Brico Engineering Limited, Coventry, England

[21] Appl. No.: 553,333

[22] PCT Filed: May 16, 1994

[86] PCT No.: PCT/GB94/01044

§ 371 Date: Jun. 12, 1996

§ 102(e) Date: Jun. 12, 1996

[87] PCT Pub. No.: WO94/27767

PCT Pub. Date: Dec. 8, 1994

[30] Foreign Application Priority Data

May 28, 1993 [GB] United Kingdom ..... 9311051

[51] Int. Cl.[6] ..... B22F 5/00; B22F 7/02

[52] U.S. Cl. ..... 419/6; 419/11; 419/25; 419/37; 419/38; 419/47; 419/54; 419/58; 75/228; 75/246; 29/890.122; 29/DIG. 31

[58] Field of Search ..... 419/6, 11, 25, 419/37, 38, 47, 54, 58; 75/228, 246; 29/890.122, DIG. 31

[56] References Cited

U.S. PATENT DOCUMENTS

| | | | |
|---|---|---|---|
| 3,790,352 | 2/1974 | Niimi et al. | 29/182.1 |
| 3,856,478 | 12/1974 | Iwata et al. | 29/182 |
| 4,035,159 | 7/1977 | Hashimoto et al. | 75/246 |
| 4,346,684 | 8/1982 | Vossieck | 123/188.5 |
| 4,424,953 | 1/1984 | Takagi et al. | 251/368 |
| 4,472,350 | 9/1984 | Urano | 419/6 |
| 4,485,147 | 11/1984 | Nishino et al. | 428/550 |
| 4,505,988 | 3/1985 | Urano et al. | 428/569 |
| 4,509,722 | 4/1985 | Ebihara | 251/359 |
| 4,546,737 | 10/1985 | Kazuoka et al. | 123/188.5 |
| 4,632,074 | 12/1986 | Takahashi et al. | 123/90.39 |
| 4,671,491 | 6/1987 | Kuroishi et al. | 251/368 |
| 5,080,713 | 1/1992 | Oda et al. | 251/359 |
| 5,466,276 | 11/1995 | Sato et al. | 75/231 |

*Primary Examiner*—Charles T. Jordan
*Assistant Examiner*—Daniel Jenkins
*Attorney, Agent, or Firm*—Synnestvedt & Lechner

[57] ABSTRACT

A two layer valve seat insert and a method for its manufacture is described. The method comprises the steps of preparing two powder mixtures; a first powder mixture for forming the valve seat face layer; a second powder mixture for forming the valve seat base layer; sequentially introducing a predetermined quantity of each of said first and said second powder mixtures into a powder compacting die and having an interface therebetween substantially perpendicular to the axis of said die; simultaneously compacting said first and said second powder mixtures to form a green compact having two layers and sintering said green compact, wherein at least one of the chemical composition or the physical characteristics of at least one of said first and said second powder mixtures is adjusted so as to result in said valve seat face layer and said valve seat base layer having substantially the same density after compaction.

16 Claims, 1 Drawing Sheet

VALVE SEAT INSERT OF TWO LAYERS OF SAME COMPACT DENSITY

BACKGROUND OF THE INVENTION

The present invention relates to valve seat inserts for use in internal combustion engines.

Valve seat inserts which are retained in place by an interference fit in the cylinder head of an internal combustion engine are well known. Such inserts have tended in the past to be made of a single material, either by a casting or by a powder metallurgy route followed by machining to size.

More recently, two-layer valve seats made by powder metallurgy techniques have been made.

Two layer valve seat inserts comprise a seat face layer with which the seat of a popper valve usually makes contact, and a base or back-up layer which is in contact with a receiving recess in the cylinder head for example.

The functions fulfilled by each layer are distinct. Amongst other things, the seat face layer provides resistance to high temperature, hostile environments and repeated impact damage, whilst the base layer provides long term creep resistance to ensure that the interference fit of the insert in its recess does not relax too much.

U.S. Pat. No. 4,485,147 describes a two layer valve seat insert having copper powder mixed with the powder material which forms the base layer. During sintering, the copper melts and infiltrates the valve seat insert face layer. This is said to save the cost of pressing and handling separate copper alloy infiltrating blanks.

EP-A-0130604 describes a two layer valve seat insert for a diesel engine, the insert having a base layer with improved creep and wear resistance over that of the seat face layer. The two layer seat insert was produced by a double pressing operation. The valve seat inserts are made by pre-compacting the base layer and subsequently compacting a layer of a seat face alloy onto the pre-compacted base layer.

In order to reduce the cost of a valve seat insert it is desirable to provide the seat face layer in a material which is suitable for the service conditions. However, it is desirable to provide the base layer in a material which is suitable for maintaining the integrity of the interference fit in the cylinder head, but which material may be generally less highly alloyed, and therefore less expensive, than the seat face layer.

Furthermore, it is also desirable for cost reasons, to reduce the number of manufacturing steps involved in the production of a two layer valve seat insert. In this regard it is preferable to be able to compact both powder layers of the valve seat insert simultaneously. However, simultaneous compaction means that there is no individual control of the green densities of the two constituent layers.

According to a first aspect of the present invention, there is provided a method of making a two layer valve seat insert having a valve seat face layer and a base layer, the method comprising the steps of preparing two powder mixtures; a first powder mixture for forming the valve seat face layer; a second powder mixture for forming the valve seat base layer; sequentially introducing a predetermined quantity of each of said first and said second powder mixtures into a powder compacting die and having an interface therebetween substantially perpendicular to the axis of said die; simultaneously compacting said first and said second powder mixtures to form a green compact having two layers and sintering said green compact, wherein at least one of either the chemical composition or the physical characteristics of at least one of said first and said second powder mixtures is adjusted so as to result in said valve seat face layer and said valve seat base layer having substantially the same density after compaction.

The term "substantially the same density" is herein defined as a density variation of not more than 3% between the two layers, and preferably not more than 1.5%.

At least one of the first and second powder mixtures may have its chemical composition and/or physical characteristics such as powder particle shape, size distribution and apparent density, for example, adjusted so as to achieve substantially the same density in each layer.

The term 'mixture' is to be interpreted as meaning a mixture of at least two dissimilar metal powders or a mixture comprising a single metal powder but having one or more additions of, for example, lubricant wax, or an addition to promote machinability such as manganese sulphide or carbon.

The density of each layer may be measured in either absolute terms as in $Mgm^{-3}$, or as a percentage of the theoretical density.

The properties of the subsequently sintered material are often strongly dependent on the initial green density. Therefore, it is desirable to maintain the green density within a narrow band during cold compaction. The green density of each constituent layer is largely determined by the relative compressibility of the constituent powders. For a given powder blend the movement of the press ram (in a mechanical press for example) or the applied pressure (in a hydraulic press) and the depth of the powder fill in the die controls the green density and the axial thickness in the pressing direction of the component. If the densities of the respective layers vary from each other, slight variations in the respective fill weights of each powder, as must necessarily occur, from one pressing to another have a disproportionate effect on the size of each resulting valve seat insert produced. Thus, it is difficult to maintain close dimensional control of the parts being produced. However, if the two constituent powders both exhibit the same or similar compaction behaviour, as in the method of the present invention, monitoring and control of the size of the resulting green compacts are greatly facilitated.

Generally, the powder mixture constituting the valve seat face layer is more highly alloyed than that of the base layer. Thus, the valve seat face layer powder is generally consequently less compressible than the base layer because of the high alloy content. Therefore, in one embodiment of the present invention, the composition of the less highly alloyed base layer powder is adjusted such that both the powders exhibit similar compressibility.

Adjustment of the base layer material may, for example, include the mixing of different grades of iron powder. Such different grades may comprise an atomised powder having a relatively high compressibility and a sponge iron powder having a relatively low compressibility, for example. The relative proportions of each constituent powder may be adjusted so as to give an overall compressibility of the base layer powder mixture substantially the same as that of the face layer powder to give a compact having substantially the same density in each of its two layers.

In addition to controlling the pressed densities of the two layers, it is also desirable to control the size change of each layer on sintering so as to achieve a substantially equal size change in each layer. Substantially equal size change on sintering is desirable so as to minimise the amount of material which must be removed on post-sintering machining. Size control may be achieved by the addition of copper and/or carbon powder in the form of graphite, for example, to the base layer and/or face layer powder mixtures. It has been found that additions of graphite powder to the base layer reduces expansion on sintering to a level nearer that of the face layer. An addition in the range from about 0.8 to 1.2 wt % has been found to be effective.

Sometimes, a post-sintering heat treatment may be employed. In this case it is desirable to control the size change on heat treatment so as to be substantially equal in both layers.

An addition of copper powder to the backing layer has been found to increase expansion on sintering whilst a similar addition to the face layer has been found to have a relatively lower effect on size change upon sintering. Addition of copper powder is beneficial as it aids the sintering reaction as well as helping to control the size change on sintering.

In one embodiment of a two layer valve seat according to the present invention, the face layer may comprise a sintered ferrous-based alloy according to EP-B1-0 312 161 of common ownership herewith, the contents of which are included herein by reference. Ferrous-based alloys according to claims 1 to 7 and made by the method described in claims 8 to 14 of EP-B1-0 312 161 have been found to be particularly suitable for the working faces of valve seat inserts.

Two layer valve seats according to the present invention may be infiltrated with a copper-based alloy, preferably simultaneously during, or alternatively, subsequent to sintering. Furthermore, two layer valve seats according to the present invention may be infiltrated whether or not the constituent layers have had copper additions made thereto in the initial powder mixtures.

According to a second aspect of the present invention there is provided a two layer valve seat insert when made by the method of the first aspect.

In order that the present invention may be more fully understood, examples will now be described by way of illustration only with reference to the accompanying drawings, of which:

PREFERRED EMBODIMENTS OF THE INVENTION

EXAMPLE 1

Figure 1:
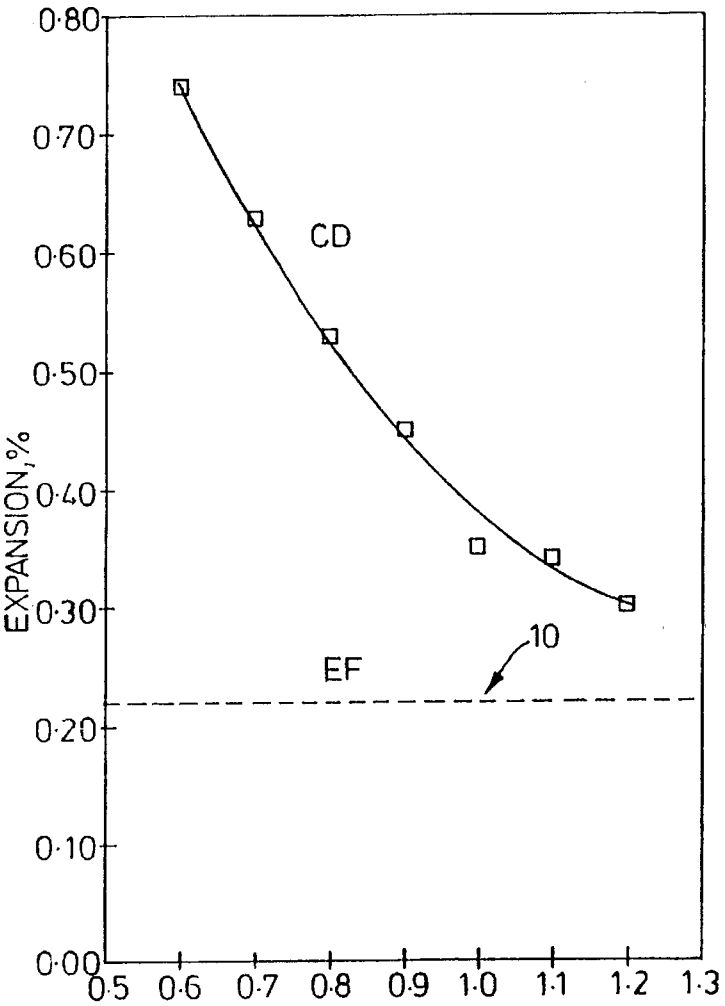
FIG. 1 shows a graph of the effect of graphite additions on the size change of backing layer powders following sintering and heat treatment.

A powder mixture for the seat face layer was prepared by mixing 49.5 wt % of a pre-alloyed steel powder of composition: 1%C; 4% Cr; 6% Mo; 3% V; 6% W; Balance Fe with 49.5 wt % of an unalloyed atomised iron powder and 0.5 wt % of graphite powder. An addition of 1 wt % of a lubricant wax was also made.

A range of powder mixtures for the backing layer were made by mixing 70 wt % of an atomised iron powder with 30 wt % of a sponge iron powder and from 0.6 wt % to 1.2 wt % of graphite powder. The addition of the sponge iron powder was made in order to reduce the compressibility of the backing layer powder mixture to that of the face layer powder mixture. No further alloying additions were intentionally made. An addition of 1 wt % of a lubricant wax was also made to each powder mixture.

A number of single layer pressings in the form of hollow cylindrical blanks were made from each of the powder mixtures, the pressing pressure being 770 MPa. Dimensions of the blanks were 6 mm axial thickness and 6mm radial thickness. Blanks made from the face layer powder mixture were coded "EF", whilst blanks made from the backing layer powder mixture were coded "CD". All the pressed blanks were infiltrated with a copper-based alloy during sintering which was carried out at about 1100° C. in an atmosphere of a hydrogen/nitrogen mixture.

Some two layer blanks were produced by the simultaneous compaction at 770 MPa of two powder layers in a die. These blanks were also sintered and infiltrated as in the blanks described above.

A post-sintering heat treatment was also effected comprising the steps of cooling the sintered blanks to −120° C., followed by tempering at 600° C. for 2 hours under a protective atmosphere.

Green density measurements were made on the pressed blanks as were density and size change measurements on the sintered articles and on the articles following a post-sintering heat treatment.

FIG. 1 shows the effect of varying levels of carbon addition on the size change on sintering and subsequent heat treatment. As the carbon content increases, the expansion of the backing layer composition decreases towards that of the face layer as shown by the horizontal line 10.

The green density of the seat face layer, EF, was 6.85 $Mgm^{-3}$. Table 1 below shows the green density of the backing layer compositions at varying levels of carbon addition.

TABLE 1

| C content of the backing layer alloy wt % | Green Density, $Mgm^{-3}$ |
|---|---|
| 0.6 | 6.88 |
| 0.7 | 6.87 |
| 0.8 | 6.86 |
| 0.9 | 6.85 |
| 1.0 | 6.86 |
| 1.1 | 6.86 |
| 1.2 | 6.85 |

Table 1, therefore, shows that the compressibility of the backing layer compositions compares well with that of the face layer, EF, for a carbon range from 0.6 to 1.2 wt %, whilst FIG. 1 shows that the expansion on sintering decreases with increasing carbon level. However, microstructural examination shows that at the lower levels of carbon addition there is evidence of carbon depletion at the interface between the two layers. This depletion is a result of the strong carbide-forming alloying elements in the seat face layer acting as a sink for the carbon. However, at carbon levels above 1.2wt %, the microstructure of the two layer samples shows the backing layer to include some discontinuous grain boundary carbides which is also undesirable. Thus, the desirable level of carbon in the base layer should be in the range from 0.8 to 1.2 wt %. Significant carbon depletion in the backing layer is undesirable since adequate strength and hardness are required to ensure that the valve seat insert is retained in the cylinder head during operation of the engine.

EXAMPLE 2

Further examples of single layer and two layer pressings were made in the non-infiltrated condition.

Powder mixtures for the face layer were as described above with reference to Example 1, but with the addition of 1 wt % manganese sulphide and copper powder in the range from 0 to 4 wt %.

Powder mixtures for backing layers having copper additions in the range from 0 to 4 wt %, 0.5 wt % manganese sulphide and 1 wt % of carbon were also prepared. The mixture of atomised and sponge iron powders were as described with reference to Example 1.

Samples pressed from the seat face layer powders were coded "SF", whilst those samples made from the backing layer powders were coded "BK".

Table 2 below shows the green densities in $Mgm^{-3}$ of the face and backing layers. In the table, the numeral following the layer code specifies the level of copper addition.

TABLE 2

| Alloy | Cu wt % | Green Density $Mgm^{-2}$ |
|---|---|---|
| SF-0 | 0 | 6.79 |
| SF-2 | 2 | 6.81 |
| SF-4 | 4 | 6.80 |
| BK-0 | 0 | 6.80 |
| BK-2 | 2 | 6.83 |
| BK-4 | 4 | 6.84 |

Figure 2:
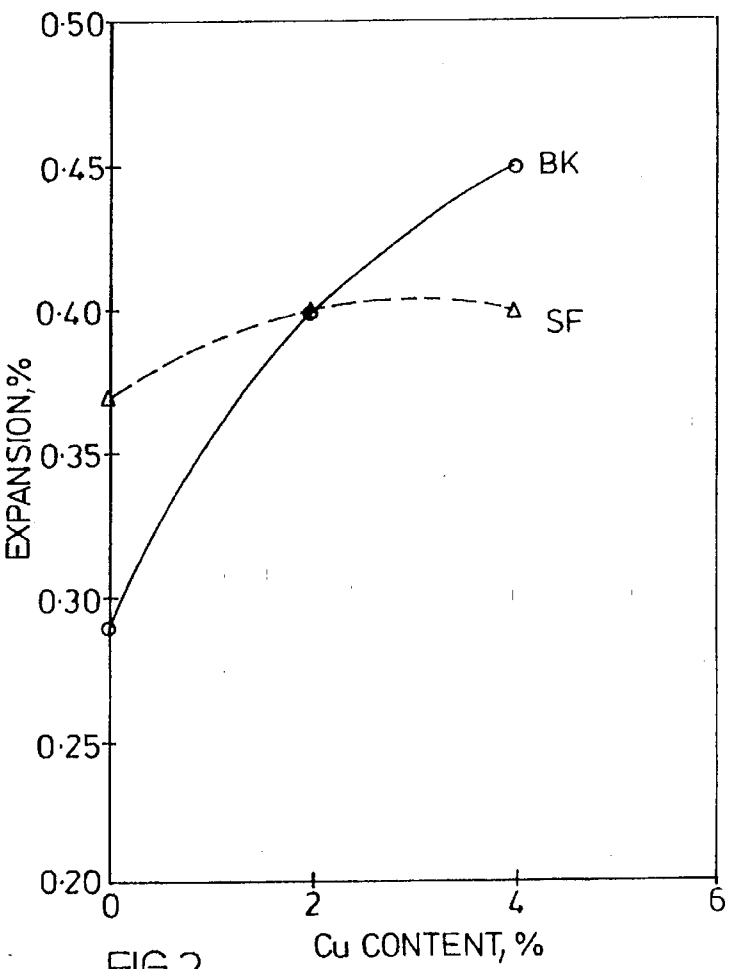
FIG. 2 which shows a graph of the effect of admixed copper content on size change following sintering and heat treatment.

Table 2 shows that the compressibility of the powder mixtures for the two layers were close for copper additions in the range from 0 to 4 wt % of copper. FIG. 2 shows that the size change on sintering of the face layer is relatively insensitive to the addition of copper to the powder mixture. However, the size change on sintering of the backing layer is much more sensitive to the addition of copper. An addition of 2 wt % in the backing layer causes a size change on sintering and subsequent heat treatment substantially the same as that of the face layer. Since the addition of copper produces benefits in the strength of the sintered material as well as helping to control the size change on sintering, an addition of between 2 and 4 wt % is desirable in non-infiltrated material. This is fortuitous since the addition of copper in this range has long been known to act as a sintering aid for ferrous-based materials.

I claim:

1. A method of making a two layer valve seat insert having a valve seat face layer and a base layer, the method comprising the steps of preparing two powder mixtures; a first powder mixture for forming the valve seat face layer; a second powder mixture for forming the valve seat base layer; sequentially introducing a predetermined quantity of each of said first and said second powder mixtures into a powder compacting die and having an interface therebetween substantially perpendicular to the axis of said die; simultaneously compacting said first and said second powder mixtures to form a green compact having two layers and sintering said green compact, characterised in that said valve seat face layer and said valve seat base layer have substantially the same green density after compaction and in that said two layers have substantially equal size change on sintering;said size change on sintering being controlled by a step selected from the group comprising the addition of up to 6 wt % copper to at least one of said powder mixtures;and;the addition of carbon powder in the range from 0.6 to 1.2 wt % to the base layer powder mixture.

2. A method according to claim 1 characterised in that the density after compaction is determined in $Mgm^{-3}$.

3. A method according to claim 1 characterised in that the density after compaction is determined as a percentage of the theoretical full density.

4. A method according to claim 1 characterised in that at least one of the powder mixtures is a mixture of at least two different constituent metal powders so as to achieve a desired compacted density.

5. A method according to claim 4 characterised in that the powder mixture constituting the valve seat face layer comprises a highly alloyed ferrous-based powder and a relatively pure iron powder.

6. A method according to claim 4 characterised in that the powder mixture constituting the valve seat base layer comprises a powder of a relatively high compressibility and a powder of a relatively low compressibility.

7. A method according to claim 6 characterised in that the relatively high compressibility powder and the relatively low compressibility powder are both substantially pure iron powders.

8. A method according to claim 6 characterised in that the relatively high compressibility powder is an atomised iron powder and the relatively low compressibility powder is a sponge iron powder.

9. A method according to claim 1 from characterised in that the two layers have substantially equal size change on heat treatment after sintering.

10. A method according to claim 8 characterised in that the two layers have substantially equal size charge on heat treatment after sintering.

11. A method according to claim 1 characterized in that the additions of copper lie in the range from 0 to 6 wt %.

12. A method according to claim 10 characterised in that said size change is at least partly controlled by additions of carbon powder to at least one of said powder mixtures.

13. A method according to claim 12 characterised in that said carbon powder addition is made to the base layer powder mixture.

14. A method according to claim 13 characterised in that the carbon powder addition lies in the range from 0.8 to 1.2 wt %.

15. A method according to claim 1 characterised by further including the step of infiltrating said two layer valve seat with a copper-based material.

16. A two-layer valve seat insert characterised by being made by the method of any one of claims 1 to 15.

* * * * *